United States Patent [19]

Robnett

[11] 4,307,992

[45] Dec. 29, 1981

[54] LOAD HANDLING VEHICLE WITH A BUCKET SIDE TILT MECHANISM

[75] Inventor: James J. Robnett, Happy Valley, Oreg.

[73] Assignee: Raygo Wagner, Inc., Portland, Oreg.

[21] Appl. No.: 83,989

[22] Filed: Oct. 11, 1979

[51] Int. Cl.[3] ..... E02F 3/76

[52] U.S. Cl. ..... 414/705; 414/722; 414/697; 172/828

[58] Field of Search ..... 414/699, 705, 685, 722, 414/697; 172/803, 807, 809, 804

[56] References Cited

U.S. PATENT DOCUMENTS

| | | | |
|---|---|---|---|
| 2,684,163 | 7/1954 | Boulton | 414/705 |
| 3,184,869 | 5/1965 | Olsen | 172/803 |
| 3,998,277 | 12/1976 | Wirt | 172/804 |
| 4,019,588 | 4/1977 | Casey | 172/804 |

*Primary Examiner*—Trygve M. Blix
*Assistant Examiner*—Terrance L. Siemens
*Attorney, Agent, or Firm*—Klarquist, Sparkman, Campbell, Leigh, Whinston & Dellett

[57] ABSTRACT

A load handling vehicle includes a bucket side tilt mechanism with a supporting H-framework comprised of first and second side frame members and a cross-frame member. The side frame members are each coupled at a first end to the body of the vehicle and at a second end to the bucket, while the cross-frame member is pivoted at each end to a respective one of the side frame members so that the cross-frame member pivots during tilting of the bucket and relieves stress on the framework. A pair of dump cylinders coupled between the framework and bucket are provided for emptying the bucket. In addition, a hoist cylinder extends between the framework and the body of the vehicle, at each side of the vehicle, for raising and lowering the framework and thereby the bucket. A tilt cylinder is tandem with one of these hoist cylinders is extended and retracted to tip the framework and in turn tilt the bucket relative to horizontal as desired. A low-pressure relief mechanism is provided for relieving hydraulic pressure at the bucket side of the dump cylinders to minimize stresses applied to the bucket as the tilt cylinder operates.

16 Claims, 6 Drawing Figures

LOAD HANDLING VEHICLE WITH A BUCKET SIDE TILT MECHANISM

BACKGROUND OF THE INVENTION

1. Field of the Invention

The present invention relates to load handling vehicles, and in particular to such vehicles with a bucket and a mechanism for tilting the bucket with respect to horizontal.

2. Description of the Prior Art

A number of prior art load handling vehicles having buckets or blades are known to have a mechanism for tilting the bucket with respect to horizontal.

Among such tilt mechanisms are those of the type having a pair of side arms rigidly connected together by a crossbar to form a fixed H-frame framework. The arms are each pivoted at a first end to the body of the vehicle and pivoted at their opposite or second end to the bucket. A short stroke hydraulic cylinder is connected at one end to the bucket and at its other end to one of the arms. Also, a rigid link is connected at one end to the bucket and its other end to the other arm. With this construction, operation of the short stroke cylinder applies a torsional load to the bucket and physically twists it. This racking or twisting of the bucket tilts it with respect to horizontal. However, because of the repeated physical twisting, such buckets are subject to breakage and fatigue failure. Furthermore, the buckets are relatively expensive to construct because reinforcing and heavier components must be utilized to withstand the torsional stresses applied to the bucket during tilting.

In another known type of prior art tilt mechanism, a bucket is pivotally connected to the body of a vehicle by an H-frame framework which includes a pair of arms and a cross-member. In addition, a hoist cylinder is connected at one end to a first of the arms and at its other end to the vehicle body while another hoist cylinder extends between the other arm and vehicle body. Simultaneous extension and retraction of these hoist cylinders respectively lowers and raises the framework and hence, the bucket. Also, in this device, the bucket is tilted by extending one hoist cylinder while simultaneously retracting the other hoist cylinder. This physically twists both the H-frame framework and the bucket and causes the bucket to tilt. A cam actuated air switch is provided to control the hoist cylinders to limit the maximum tilt of the bucket. In addition, the cross-member is pivoted at its respective ends to the side arms to twist as the bucket is tilted to partially take up stresses applied to the framework during tilting.

However, in common with the other prior art devices, this particular mechanism highly stresses the bucket. Consequently, the bucket is subject to failure and must be heavily constructed to withstand the torsional loading applied to it during tilting. Furthermore, vehicles of this type are often used in dusty areas. This dust easily clogs air actuated switches and prevents such switches from effectively limiting the twisting of the bucket. As a result of failure of such limit switches, buckets on these vehicles are frequently damaged because of stresses from excess tilting.

Therefore, a need exists for a load handling vehicle having a side tilt mechanism for a bucket which minimizes the stresses applied to the bucket during tilting.

SUMMARY OF THE INVENTION

In accordance with the invention, a load handling vehicle includes a bucket pivoted to a supporting framework, which in turn is pivoted to a body portion of the vehicle. Plural hydraulic spaced-apart hoist cylinder means are provided for raising and lowering the framework and thus the bucket. Hydraulic tilt cylinder means in tandem with at least one of such hoist cylinder means is provided to vary the effective length of one such hoist cylinder means relative to the other such hoist cylinder means to thereby tilt the bucket relative to horizontal.

As another feature of the invention, hydraulic dump cylinder means are provided for pivoting the bucket relative to the framework to empty it and, a low pressure relief mechanism is provided for relieving the hydraulic pressure at the bucket side of said dump cylinder means during tilting of the bucket to minimize stresses applied to the bucket during tilting.

As a more specific feature of the invention, the framework comprises a pair of generally parallel spaced-apart side arm members interconnected by a cross-member to form an H-frame, a first hydraulic cylinder extends between one of said side arm members and the body of the vehicle and a second hydraulic cylinder extends between the other of said arms and the body of the vehicle, and a hydraulic tilt cylinder is provided in tandem with one of said hoist cylinders to tip the frame and tilt the bucket as desired.

As still another feature of the invention, the cross-frame member is pivoted at one end to a first of said sidearm frame members and pivoted at its opposite end to the other of said side frame members, such that the cross-frame member pivots about its axis during tilting of the bucket to minimize stresses on the frame.

As a further, more specific feature of the invention, the dump cylinder means comprises a first dump cylinder extending between the first of said side arm members and the bucket and a second dump cylinder means extending between the other of said side arm members and the bucket, and the low-pressure relief mechanism comprises means for relieving hydraulic pressure on the bucket side of each of such dump cylinder means during tilting of the bucket.

As a still more specific feature of the invention, such dump cylinders each have their rod or stem ends pivoted to the bucket and said low-pressure relief mechanism comprises a means for relieving hydraulic pressure at such rod ends.

It is accordingly a broad object of the invention to provide a load handling vehicle with a side tilt mechanism for a bucket which minimizes stresses applied to the bucket during tilting.

It is a further object of the invention to provide a bucket side tilt attachment for a load handling vehicle in which the stresses applied to the bucket during tilting are minimized.

It is still another object of the invention to provide a hydraulically operated side tilt mechanism for a vehicle which is easily and reliably controlled, and which is long lasting as well as relatively trouble-free.

It is still another object of the invention to provide a bucket side tilt mechanism which is relatively low cost, mechanically simple, and which requires little maintenance.

Another object of the invention is to provide a side tilt mechanism for a load handling vehicle with a bucket of relatively low cost construction with a minimum of reinforcing components.

These and other objects, features, and advantages of the invention will become apparent with the following description, which proceeds with reference to the accompanying drawings.

DETAILED DESCRIPTION OF PREFERRED EMBODIMENT

Overall Description of Vehicle

Figures 1, 3, 5, 6:
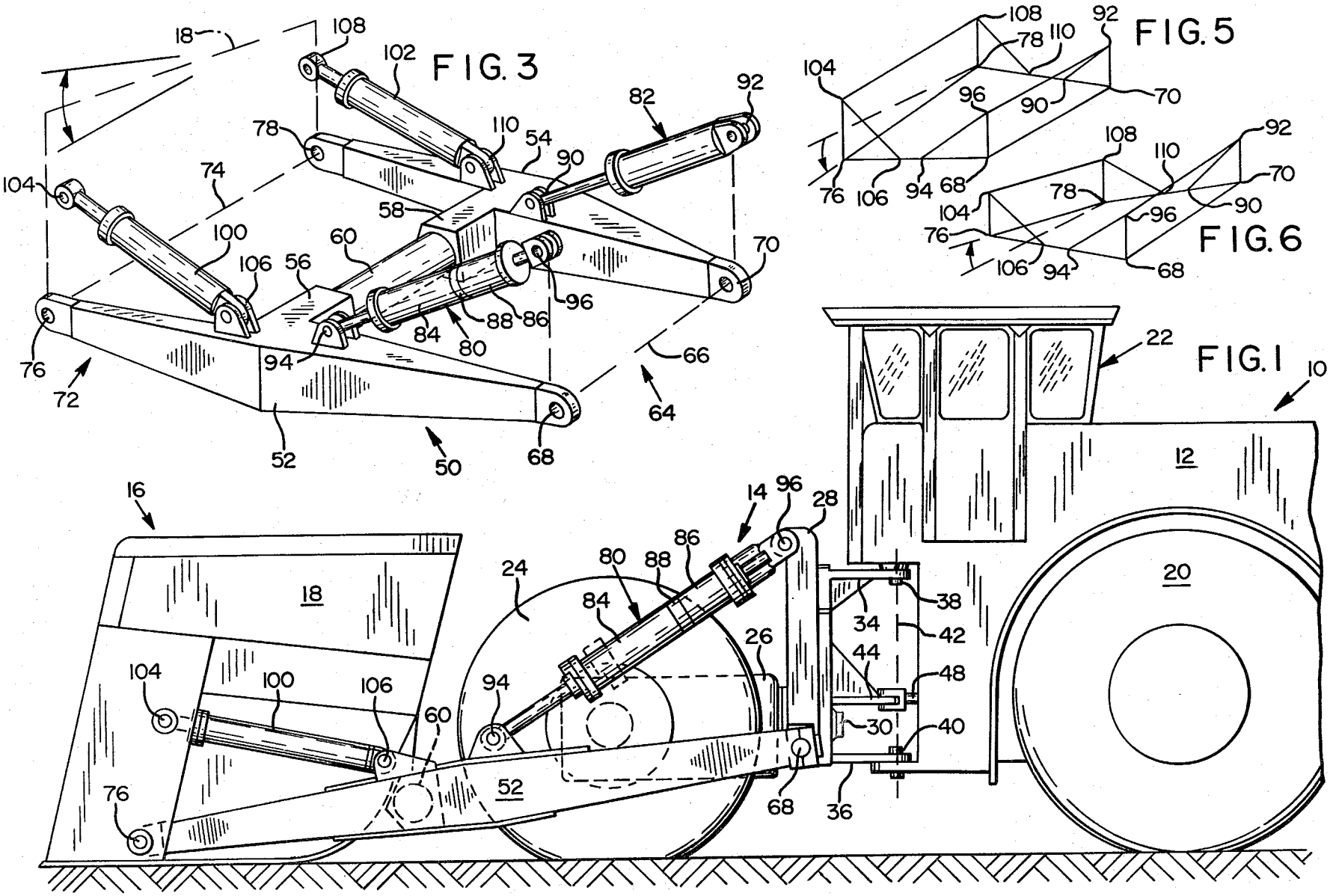
FIG. 1 is a side elevational view of a load handling vehicle with a side tilt mechanism in accordance with the invention, and with portions thereof shown in dashed lines.
FIG. 3 is a perspective view of a side tilt mechanism in accordance with the invention.
FIG. 5 is a schematic diagram of the side tilt mechanism of FIG. 3 in one operating position.
FIG. 6 is a schematic diagram of the side tilt mechanism of FIG. 3 in another operating position.
Figure 2:
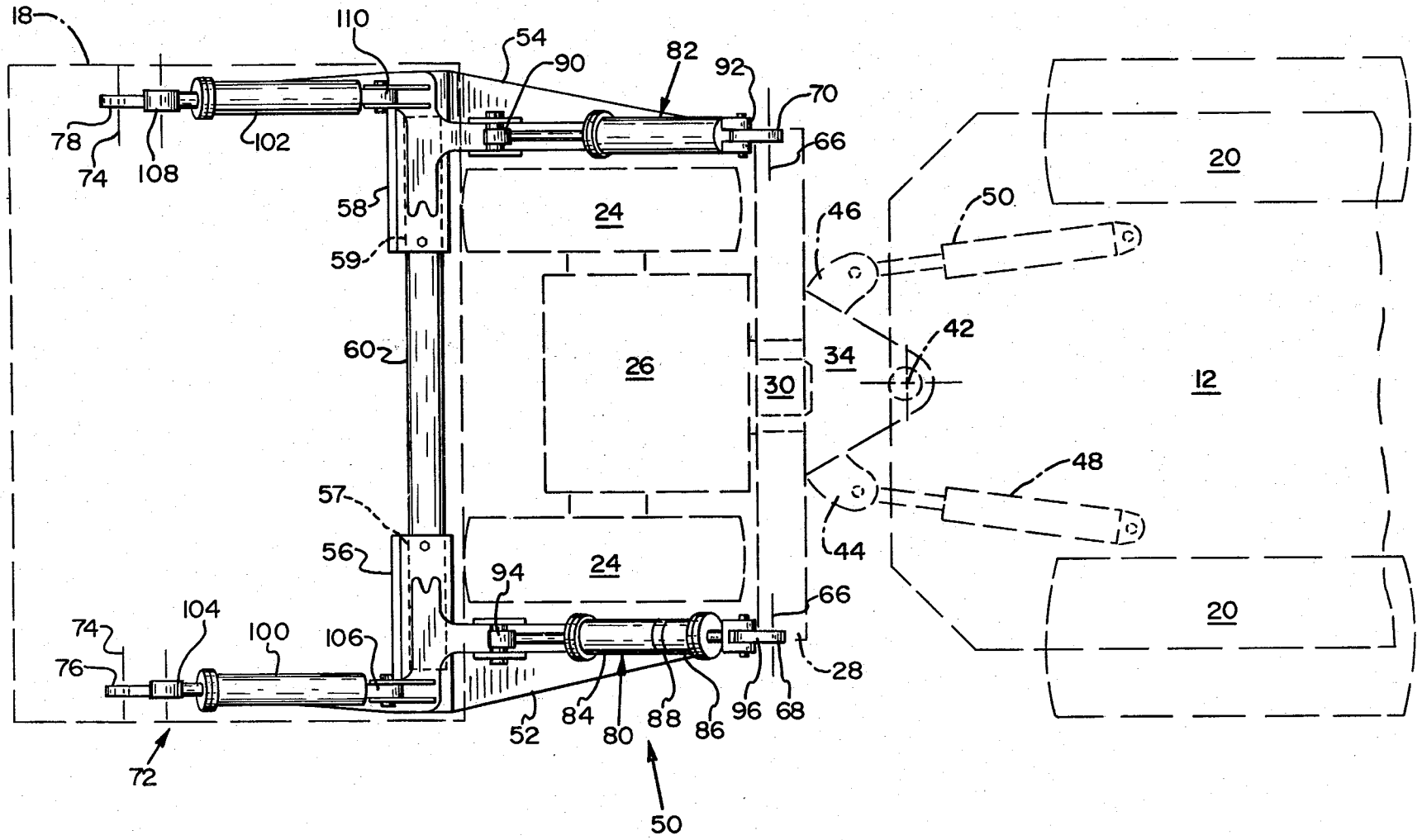
FIG. 2 is a top plan view of the side tilt mechanism of FIG. 1 with additional portions of the vehicle shown in dashed lines.

With reference to FIGS. 1 and 2, a load handling vehicle in accordance with the invention includes an articulated frame 10 comprising a rear or main body 12 and a steerable forward body or bogie portion 14. The vehicle also includes a forwardly projecting load handling attachment 16 which, in the illustrated embodiment includes a bucket 18. Although the term bucket is used throughout the specification, it is not to be construed as a limitation. That is, the term bucket is intended to include any suitable load handling device, whether it be a blade, scoop or other member.

Main body 12 is supported by a pair of driven wheels 20 operable in a conventional manner and controlled by controls conveniently located in a cab 22 carried by body 12. Steerable body 14 includes a pair of driven and steerable wheels 24 mounted on a conventional wheel supporting framework 26. The steerable body also includes an upright, generally rectangular, rigid mounting block or support 28 to which wheel supporting framework 26 is journaled by a conventional pivot tube and bearing assembly 30. Thus, steerable body 14 is free to oscillate about the axis of pivot 30 as the vehicle travels over uneven terrain.

An upper, generally horizontal, plate-like body connecting flange 34 projects rearwardly from an upper portion of mounting block 28 while a similar lower flange 36 projects rearwardly from a lower portion of the mounting block. Flanges 34, 36 are pivoted by respective pins 38, 40 to main body 12. Therefore, the portion of the vehicle forward of pins 38, 40 is free to pivot about a generally vertical steering axis 42 (represented by dashed lines in FIG. 1) through the pins. First and second rigid steering flanges or ears 44, 46 project rearwardly of mounting block 28 on opposite sides of steering axis 42. A hydraulic steering cylinder 48 is connected at one end to ear 44 and at its other end to main body 12 while a similar hydraulic steering cylinder 50 is connected at its respective ends to the body 12 and ear 46. Extension and retraction of cylinders 48, 50, in response to controls located in cab 22, pivots the front end of the vehicle about steering axis 42 to steer the vehicle in a well-known manner.

SIDE TILT MECHANISM

As shown in FIG. 3, the side tilt mechanism includes a bucket supporting framework 50 comprising first and second rigid, elongated, generally parallel spaced-apart side arm members 52, 54. Side arm 52 includes a sleeve defining block portion 56 projecting generally normal to the longitudinal axis of the side arm and inwardly toward side arm 54. Similarly, side arm 54 includes an inwardly projecting sleeve defining block portion 58. A pivot tube 60 interconnects side arm 52 and side arm 54. More specifically, one end portion of tube 60 is pivotally received within a sleeve 57 defined by block portion 56 while the other end portion of tube 60 is pivotally received within a sleeve 59 defined by block portion 58. Suitable bushings or bearings are disposed between tube 60 and members 56, 58. Therefore, sleeve 60 is free to pivot relative to side arms 52, 54 to relieve stress otherwise applied to framework 50 during tilting of the mechanism, as explained below. Thus, in its preferred form, framework 50 comprises an H-shaped frame supporting structure having side arms 52, 54 and a cross-member or pivot tube 60.

A first end portion 64 of framework 50 is pivoted to mounting block 28 such that the framework may be raised and lowered relative to the body 12 of the vehicle about a generally horizontal pivot axis indicated at 66 in FIG. 3. More specifically, a first end portion of arm 52 is pivoted at 68 to a lower side edge portion of mounting block 28 while a corresponding end portion of arm 54 is pivoted at 70 to the opposite lower side edge portion of the mounting block. In addition, the outer end portion 72 of framework 50 is pivoted to bucket 18 such that the bucket is free to move about a generally horizontal axis 74 for dumping purposes. More specifically, the second end portion of arm 52 is pivoted at 76 to one lower side portion of the bucket while the corresponding end portion of arm 54 is pivoted at 78 to a lower opposite side portion of the bucket.

Fluid hoist means are provided for pivoting the framework 50 about axis 66 to raise and lower the bucket. Such fluid hoist means preferably comprises plural hydraulic hoist cylinder means. More specifically, as shown in FIG. 3, such hoist means may comprise a first hydraulic hoist cylinder mechanism 80 extending between a midsection portion of arm 52 and an upper side edge portion of mounting block 28 and a second hydraulic hoist cylinder mechanism 82 extending between a mid-section portion arm 54 and an opposite upper side edge portion of mounting block 28. For purposes explained below, at least one of the cylinder mechanisms 80, 82, in the illustrated embodiment cylinder mechanism 80, comprises a conventional tandem hydraulic cylinder which includes a hydraulic hoist cylinder portion 84 and a tilt cylinder portion 86 separated by a fixed plate 88. Hoist cylinder portion 84 and tilt cylinder portion 86 extend and retract along a common axis or line. Hoist cylinder 82 is pivoted at 90 to arm 54 and at 92 to mounting block 28. In addition, hoist cylinder mechanism 80 is pivoted at 94 to arm 52 and at 96 to mounting block 28.

Hoist cylinder portion 84 of the tandem cylinders and hoist cylinder 82 are preferably of the same stroke and are supplied with hydraulic fluid through a commercially available flow-splitter mechanism such that they operate together to raise and lower framework 50, and hence the bucket 18, about axis 66. That is, with tilt cylinder portion 86 of the cylinder mechanism 80 in a fixed or locked position, cylinders 82, 84 will raise and lower both sides of the framework together in unison.

The side tilt mechanism is also provided with a hydraulically controlled dumping means for pivoting bucket 18 about axis 74 to empty its contents. Preferably, such dumping means comprises a plural hydraulic cylinder means such as a hydraulic cylinder 100 and a hydraulic cylinder 102. As shown in FIG. 3, the rod or stem end of cylinder 100 is pivoted at 104 to an upper side edge portion of bucket 18 while the piston end of this cylinder is pivoted at 106 to a mid-section portion of arm 52. Although not required, preferably the rod or stem ends of the dump cylinders are connected to the bucket because during dumping, it is desirable to apply fluid to the piston side of these cylinders as this produces more available power for dumping purposes. In addition, the stem end of cylinder 102 is pivoted at 108 to an upper side edge portion of bucket 18 opposite pivot 104 and the piston end of cylinder 102 is pivoted at 110 to a mid-section portion of arm 54. It will be appreciated that extension of cylinders 102, 104 causes bucket 18 to pivot forwardly about axis 74 to empty its contents, while retraction of these cylinders pivots the bucket in the opposite direction.

As previously mentioned, hydraulic cylinder mechanism 80 includes a side tilt cylinder portion 86 in tandem with hoist cylinder portion 84. Side tilt cylinder 86 preferably comprises a short stroke hydraulic cylinder operable to vary the distance between points 94–96 relative to the distance between points 90–92. That is, in its neutral or non-tilt position, the distance between points 94–96 is identical to the distance between points 90–92 such that arms 52 and 54 are parallel to one another and bucket 18 is generally horizontal, assuming for discussion purposes that the vehicle is being operated on level ground. On the other hand, as explained in greater detail in connection with the operation of the vehicle, extension of tilt cylinder portion 86 increases the distance between points 94–96 while the distance between points 90–92 remains constant. This in turn forces point 76 and the corresponding portion of bucket 18 downwardly relative to point 78 at the opposite side of the bucket and thereby tilts the bucket. In addition, retraction of cylinder 86 shortens the distance between points 94–96 while the distance between points 90–92 remains constant. This raises point 76 and the corresponding portion of the bucket relative to point 78 so that the bucket is tilted in the opposite direction with respect to horizontal.

As a specific example, in one embodiment of the invention having a tilt cylinder with a total stroke of eight inches, four inches in each direction from its neutral position, actuation of tilt cylinder 86 causes point 76 to tilt a maximum of approximately a total of thirty four inches, seventeen inches in each direction from horizontal. Also, as cylinder 86 is extended and retracted, pivot tube 60 pivots and relieves stress that otherwise would be applied to framework 50.

To further reduce stresses applied to bucket 18 during tilting, as explained more fully below in connection with the discussion of the hydraulic circuit of the invention, a low-pressure relief mechanism is provided for relieving pressure at the bucket side of cylinders 100, 102. Hence, with cylinders 100, 102 mounted as shown in FIG. 3, this pressure relief mechanism relieves pressure at the stem side of such cylinders during tilting. In particular, as the cylinder 86 is extended, a tensile force is applied to cylinder 100 and it is permitted by the pressure relief mechanism to elongate and reduce the stress on the bucket. In contrast, a compressive force is applied to cylinder 102 and it remains locked. Conversely, retraction of tilt cylinder 86 applies a tensile force to cylinder 102 and a compressive force on cylinder 100. In this situation, cylinder 102 is permitted by the low-pressure relief mechanism to elongate and thereby relieve stress on the bucket.

The extent of tilting is positively limited by the length of the stroke of the cylinder 86 and does not depend upon failure prone air actuated switches. Furthermore, by selecting a tilt cylinder of a desired stroke, the maximum degree of tilting of the bucket with respect to horizontal is controlled.

Each of the connections between the cylinders and other structural members preferably comprises a conventional ball-type pivot connection permitting some rotation as well as pivoting. Similar ball-type pivot connections join framework 50 to bucket 18 and main body 12.

Thus, a bucket tilt mechanism in accordance with the invention is reliable and minimizes stresses applied to the bucket during tilting.

HYDRAULIC CIRCUIT

Figure 4:
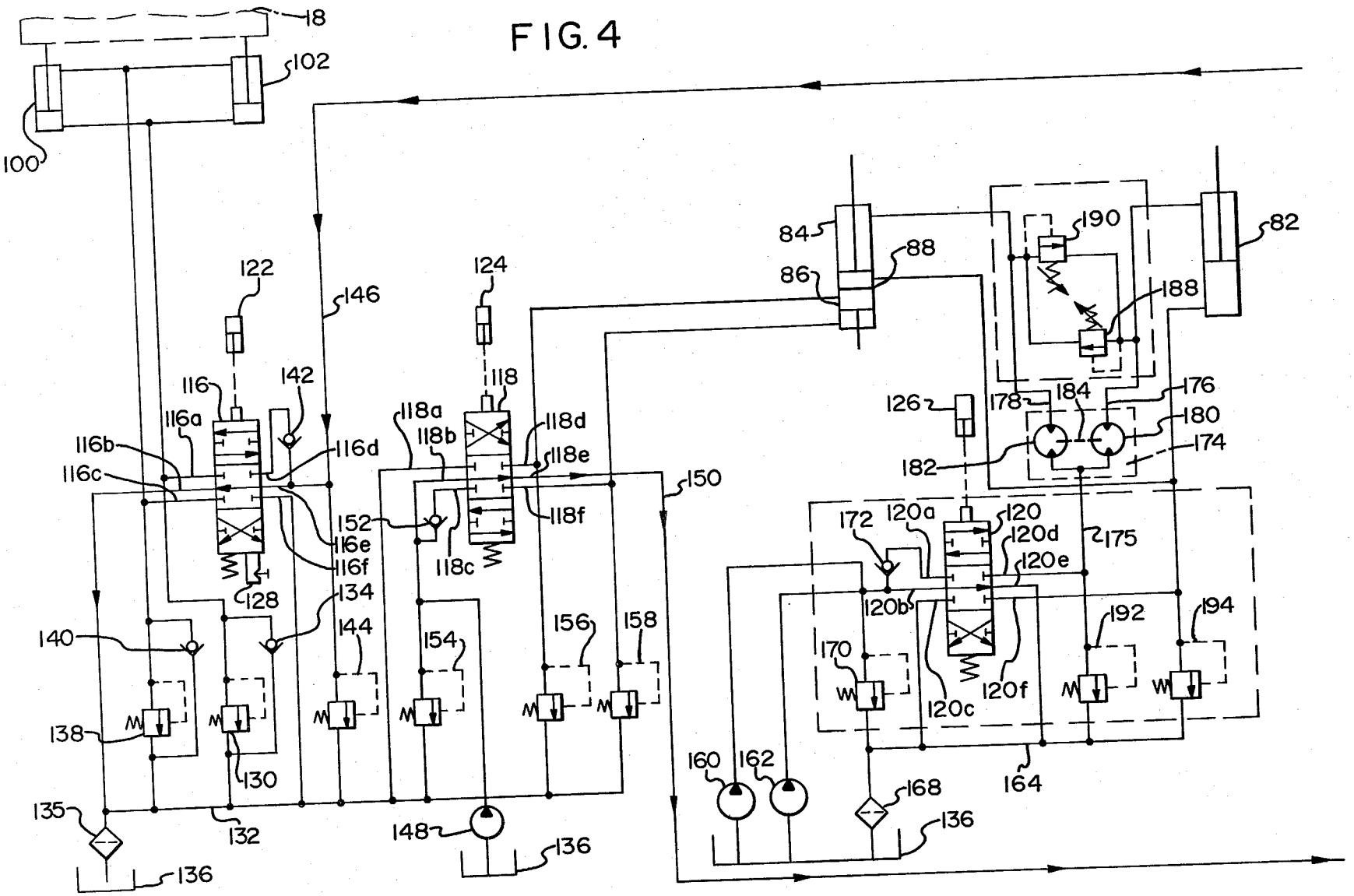
FIG. 4 is a schematic diagram of a hydraulic circuit for the side tilt mechanism of FIG. 3.

With reference to FIG. 4, a hydraulic circuit for operating the side tilt mechanism of FIG. 3 includes a dump cylinder control valve 116, a tilt cylinder control valve 118, a main hoist cylinder control valve 120 and a steering cylinder control valve (not shown). Each of these control valves has six ports respectfully labelled **116*a*–116*f*, 118*a*–118*f*, and 120*a*–120*f*. Furthermore, each of these valves comprises a conventional three-way valve having a neutral position, a forward flow position, and a reverse flow position. An air controlled hydraulic actuation cylinder 122 is provided to shift valve 116 between its operating positions. Similar actuating cylinders 124, 126 are provided for controlling the respective valves 118, 120. Actuation cylinders 122, 124 and 126** are controlled from the cab of the vehicle for convenience and operate to shift the respective valves against a suitable spring biasing mechanism.

When valves 116, 118 and 120 are in their neutral position, a flow path is provided between ports b and e and the remaining ports are blocked. In addition, when each valve is in its forward position, ports b and e are blocked, a flow path is provided between ports a and d, and a flow path exists between ports c and f. Also, when each valve is in its reverse flow position, ports b and e are blocked, a flow path exists between ports a and f, and a flow path exists between ports c and d.

Port **116*a* is connected by a hydraulic line to the piston side of each of the dump cylinders 100, 102 and also through a conventional pressure relief valve 130 to a return line 132 which leads to a filter 134 and in turn to the hydraulic fluid supply tank 136. A check valve 134 permits fluid to flow from line 132 back to port 116*a* and hence to the cylinder side of dump cylinders 100, 102. Ports 116*b* and 116*f* are connected to return line 132. In addition, port 116*c* is connected through a hydraulic line to the stem or rod side of the respective dump cylinders 100, 102 and also through a conventional pressure relief valve 138 to line 132. A check valve 140 permits fluid to flow from line 132 to the rod side of cylinders 100, 102. Port 116*e* is coupled through a check valve 142 to port 116*d*** and also through a conventional pressure relief valve 144 to line 132. When valve 122 is in its neutral position, fluid returning from the steering cylinders on a line 146 is fed through the valve ports 116*e*, 116*b*, through filter 135 and to tank 136.

When valve 118 is in its neutral position, a pump 148 supplies hydraulic fluid from tank 136 through ports 118*b* and 118*e* to a steering fluid supply line 150, which is connected to the steering cylinder control valve. Port 118*b* is also connected through a check valve 152 to port 118*c* and, in addition, is coupled through a conventional pressure relief valve 154 to line 132 and hence to the tank. Port 118*a* is connected to line 132. Port 118*d* is connected by a hydraulic fluid supply line to the piston side of tilt cylinder 86 and also through still another pressure relief valve 156 to line 132. Also, port 118*f* is coupled both to the stem side of tilt cylinder 86 as well as through a pressure relief valve 158 to line 132.

A pair of parallel pumps 160, 162 supply fluid from tank 136 to port 120*b* of valve 120. When this valve is in its neutral position, this fluid passes through port 120*e* to a return line 164, a filter 168, and to tank 136. Port 120*b* is also coupled by a pressure relief valve 170 to line 164 and through a check valve 172 to port 120*a*. Port 120*c* is coupled to return line 164. Port 120*d* is connected to an input 175 of a conventional flow divider mechanism 174 which evenly divides the fluid it receives from port 120*d* between a pair of output lines 176, 178. Preferably, flow-splitter 174 comprises a pair of hydraulic motors 180, 182 physically interconnected by a shaft 184 such that they operate at the same speed. As motors 180 and 182 are restricted so as to operate together, the fluid from line 175 is divided equally between lines 176 and 178. Line 176 is connected to the stem side of hoist cylinder 82 and also through a conventional variable pressure relief valve 188 to line 170. In addition, line 178 is connected to the stem side of hoist cylinder 84 and also through a variable pressure relief valve 190 to line 176. Relief valves 188, 190 equalize the pressure at the stem side of the respective cylinders 82, 84 when the system is initially started to synchronize the cylinders. Port 120*d* is also coupled through a pressure relief valve 192 to return line 164 and hence to tank 136. Finally, port 120*f* is connected to the piston side of cylinders 82, 84 and through still another pressure relief valve 194 to the tank.

Pressure relief valves 130, 144, 154, 156, 158, 170, 188, 190, 192 and 194 are each set in a conventional manner at a level to relieve excess pressures in their respective lines. Typically, such settings will range at on the order of from 1,800 to 2,300 pounds per square inch depending on the particular valve in question. In contrast, pressure relief valve 138 is set at a relatively low pressure level, for example within the range of from 300 to 400 psi or thereabout, to permit fluid from the stem side of cylinders 100, 102 to bleed through it as the bucket is tilted.

OPERATION OF THE LOAD HANDLING VEHICLE

As indicated above, bucket 18 is raised and lowered by hoist cylinders 82, 84. More specifically, to raise the bucket, valve 120 is shifted from its neutral position shown in FIG. 4 to its forward flow position so that hoist cylinders 82, 84 retract. When the valve is in this position, pumps 160, 162 supply fluid through check valves 172, ports 120*a*, 120*d*, flow-splitter 174 and to the stem side of the cylinders 82, 84. Also, fluid from the piston side of these cylinders is fed through ports 120*f* and 120*c* to the tank. Thus, the hoist cylinders retract and the bucket is raised. Conversely, to lower the bucket, valve 120 is shifted to its flow reversal position and the hoist cylinders elongate. When valve 120 is in this flow reversal position, pumps 160, 162 supply fluid through check valve 172, port 120*a* and port 120*f* to the piston side of cylinders 82, 84. This in turn causes these cylinders to elongate and lower the bucket.

Cylinders 100, 102 operate to dump bucket 18 as follows. To dump the bucket, valve 116 is shifted to its forward flow position to elongate the dump cylinders. When in this position, fluid returning from the steering portion of the hydraulic circuit is fed from port 116*e* through check valve 142, port 116*d* to port 116*a* and hence to the piston side of the cylinders 100, 102. In addition, fluid from the stem side of these cylinders is returned through ports 116*b* and 116*f* to the tank. As a result, cylinders 100, 102 elongate and pivot bucket 18 forwardly about axis 74. A conventional latching mechanism 128, unless interrupted by the operator in the cab, latches control valve 116 in its forward position until the cylinders 100, 102 bottom out and the bucket is completely empty. At this time, mechanism 128 becomes unlatched. Conversely, to pivot the bucket in the opposite direction about axis 174, valve 116 is shifted to its flow reversal position to cause dump cylinders 100, 102 to retract. When in this latter position, fluid is supplied from line 146, through check valve 142 to port 116*d*, and hence to port 116*b* and to the stem side of cylinders 100, 102. At the same time, fluid from the piston side of these cylinders is fed through port 116*a* and port 116*f* to the tank.

More importantly, the side tilt cylinder operates to tilt the bucket as follows. To raise the bucket portion 76 relative to horizontal, valve 118 is shifted to its flow reversal position to cause tilt cylinder 86 to elongate. When valve 118 is in this position, fluid passes from pump 148 through check valve 152, port 118*c*, port 118*d* and to the piston side of side tilt cylinder 86 causing it to elongate. This in turn increases the distance between points 94, 96 of the mechanism relative to distance between points 90, 92 and drives bucket portion 76 upwardly relative to the opposite side of the bucket. Conversely, to tilt the bucket in the opposite direction, valve 118 is shifted to its forward flow position to cause tilt cylinder 86 to retract. When valve 118 is in this latter position, fluid from pump 148 is fed through check valve 152, port 118*f* and hence to the stem side of tilt cylinder 86. At the same time, fluid from the piston side of this cylinder is returned through port 118*d* and 118*a* to the tank. As a result, the portion of the bucket at location 76 is raised with respect to horizontal.

More specifically, with reference to FIGS. 3, 5 and 6, the side tilt mechanism operates as follows. With the blade in its horizontal position as shown in FIG. 3, and the tandem side tilt cylinder 86 and hoist cylinder 84 at the lefthand side of the vehicle relative to the driver, lengthening tilt cylinder 86 causes the following to occur. The lefthand portion of the blade is tilted downwardly and, in fact, pivots about location 78 at the opposite side of the blade. Both the hoist cylinders 82 and 84 remain locked in their respective positions. In addition, pivot tube 60 permits arm 52 to move downwardly relative to arm 54 and thereby relieves stress on the supporting framework 50. In addition, the lefthand dump cylinder 100 elongates as fluid is forced from the stem side of this cylinder through the low pressure relief valve 138 (FIG. 4) to the tank. At the same time, the righthand dump cylinder 102 remains locked as the forces applied to it are opposite to those applied to the cylinder 100. That is, excess pressure is not applied to the stem side of cylinder 100. This sequence of events is represented in FIG. 5 wherein the distance between points 94 and 96 has increased relative to the distance between points 90 and 92, and the distance between points 104 and 106 has increased relative to the distance between points 108 and 110.

Conversely, to tilt the blade in the opposite direction with respect to horizontal, again with the tilt cylinder at the lefthand side of the vehicle, the following occurs. Tilt cylinder 86 is shortened to raise location 76 of the bucket with respect to horizontal. That is, location 76 pivots upwardly about point 78 at the other side of the bucket. Again, both hoist cylinders 82, 84 remain fixed as, under the example being discussed, the bucket is not being raised or lowered at this time. Furthermore, the righthand dump cylinder 102 elongates and relieves stress on the bucket as an excess pressure is present at the stem side of this cylinder, which is relieved through low-pressure relief valve 138. The force applied to cylinder 100 during tilting is opposite to that on cylinder 102 so that cylinder 100 remains locked. This sequence of events is represented in FIG. 6 in which the distance between points 94, 96 has shortened relative to the distance between points 90, 92 while the distance between points 110, 108 has increased relative to the distance between points 104, 106.

Therefore, as a result of this construction, a side tilt mechanism is provided in which the stresses applied to a bucket during tilting are minimized.

Of course, many modifications may be made to the specific preferred embodiment discussed above. For example, it has been found that the side tilt mechanism will function without a low-pressure relief mechanism such as valve 138. However, without such a low-pressure relief at the bucket side of the dump cylinders, additional stresses would be applied to the bucket.

Also, it has been found that the side tilt mechanism will function with a rigid member interconnecting side arms 52, 54 instead of a pivoting member such as 60. However, with such an alternate construction, additional stresses are applied to the frame.

In addition, tandem cylinder mechanism 80 can be positioned at either side of the vehicle as desired. For that matter, a similar tandem cylinder may be provided at each side of the vehicle for additional tilting capabilities of the bucket. However, in such a case, the mechanism is more difficult to hydraulically control. Also it has been found that a single tandem cylinder provides more than enough tilting capability for most applications.

While I have shown and described a preferred embodiment of my invention, it will be apparent to those skilled in the art that many additional changes and modifications may be made without departing from my invention in its broader aspects.

What is claimed is:

1. A load handling vehicle or apparatus comprising:

a body, said body including a support member;

a bucket supporting frame projecting forwardly of said body, said frame comprising first and second parallel generally spaced apart side arm members each pivoted at one end portion to said support member such that said side arm members and thereby said frame are free to pivot about a generally horizontal first pivot axis, the free end portion of said frame being connected to said bucket, whereby pivoting said frame in one direction about said first pivot axis raises the free end portion of the frame and thereby the bucket and pivoting the frame in the other direction about said first pivot axis lowers the free end portion of the frame and thereby the bucket;

first fluid cylinder means pivoted at one end portion to said first side arm member and having its other end portion pivoted to the support member; second fluid cylinder means pivoted at one end portion to said second side arm member and having its other end portion pivoted to the support member, said first and second fluid cylinder means each including an associated hoist cylinder means for pivoting said frame about the first pivot axis; and said first fluid cylinder means including a tilt cylinder means extensible and retractable along the same line as the associated hoist cylinder means for pivoting said first side arm about said first pivot axis and relative to said second side arm so as to tilt the free end portion of the frame and thereby tilt the bucket.

2. An apparatus according to claim 1 in which said first fluid cylinder means comprises a tandem hoist cylinder and tilt cylinder.

3. An apparatus according to claim 2 in which said frame includes a cross frame member interconnecting said first and second side arm members, said cross frame member being pivoted at one end portion to said first side arm member and pivoted at its other end portion to the second side arm member, whereby said cross frame member pivots during operation of said tilt cylinder means to reduce stress on said frame and bucket.

4. An apparatus according to claim 3 in which said free end portion of the frame is pivoted to the bucket such that said bucket is free to pivot about a generally horizontal second pivot axis, said apparatus including bucket fluid cylinder means extending between said frame and said bucket and operable to pivot said bucket about said second pivot axis and also including low pressure relief means for relieving fluid pressure above a preselected magnitude at the bucket side of said bucket fluid cylinder means.

5. An apparatus according to claim 3 in which said bucket fluid cylinder means comprises first and second bucket hydraulic cylinders positioned on opposite sides of the centerline of the bucket from one another.

6. A side tilt apparatus for coupling a bucket to a support member comprising:

a frame, said frame comprising first and second parallel generally spaced apart side arm members, each said side arm member being adapted for pivotal connection to the support member such that said side arm members and thereby the frame project forwardly of the support member and are free to pivot about a first pivot axis, the free end portion of the frame being adapted for connection to the bucket;

first fluid cylinder means pivoted at one end portion to said first side arm member and having its other end portion adapted for pivoting to the support member, second fluid cylinder means pivoted at one end portion to said second side arm member and having its other end portion adapted for pivoting to the support member, said first and second fluid cylinder means each including an associated hoist cylinder means for pivoting said frame about the first pivot axis; and said first fluid cylinder means including tilt cylinder means extensible and retractable along the same line as the associated hoist cylinder means for pivoting said first side arm about said first pivot axis and relative to said second side arm so as to tilt the free end portion of the frame and thereby tilt the bucket.

7. An apparatus according to claim 6 in which said first fluid cylinder means comprises a tandem hoist cylinder and tilt cylinder.

8. An apparatus according to claim 6 in which said frame includes a cross frame member interconnecting said first and second side arm members, said cross frame member being pivoted at one end portion to said first side arm member and pivoted at its other end portion to the second side arm member, whereby said cross frame member pivots during operation of said tilt cylinder means to reduce stress on said frame and bucket.

9. An apparatus according to claim 2 in which said free end portion of the frame is adapted for pivoting to the bucket such that said bucket is free to pivot about a generally horizontal second pivot axis, said apparatus including bucket fluid cylinder means pivoted at one end portion to said frame and adapted for pivotal connection at its other end portion to the bucket so as to pivot said bucket about said second pivot axis and also including low pressure relief means for relieving fluid pressure above a preselected magnitude at the bucket side of said bucket fluid cylinder means.

10. An apparatus according to claim 3 in which said bucket fluid cylinder means comprises first and second bucket hydraulic cylinders positioned on opposite sides of the centerline of the frame from one another.

11. A load handling vehicle comprising:

a body, said body including a support member;

a bucket;

a bucket supporting frame comprising first and second generally parallel spaced apart elongated side arm members, said frame also including a cross-frame member positioned with its longitudinal axis generally normal to said side frame members, said cross-frame member being pivoted at one end portion to a midsection of said first side arm member and pivoted at its other end portion to a midsection of said second side arm member such that said cross-frame member is free to pivot about its longitudinal axis, a first end portion of each said side arm member being pivoted to said support member such that said side arm members and thus said frame are pivotal about a first generally horizontal pivot axis, a second end portion of each said side arm member being pivoted to said bucket such that said bucket is pivotal about a second generally horizontal pivot axis, whereby pivoting said side arm members together in one direction about the first pivot axis raises the frame and thereby the bucket while pivoting said side arm members together in the other direction about the first pivot axis lowers the frame and thereby the bucket;

a first hydraulic hoist cylinder pivoted at one end portion to said first side arm member and pivoted at its other end portion to said support member;

a tandem hydraulic cylinder mechanism pivoted at one end portion to said second side arm member and pivoted at its other end portion to said support member, said tandem cylinder mechanism including a hoist cylinder portion operable together with said first hoist cylinder to raise and lower said side arm members together, said tandem cylinder mechanism also including a tilt cylinder portion operable to pivot said second side arm member about said first pivot axis and relative to said first side arm member to thereby tilt the portion of the bucket connected to said second side arm member relative to the portion of the bucket connected to said first side arm member;

a first hydraulic dump cylinder pivoted at a first end portion to said bucket and pivoted at a second end portion to said first side arm member and a second hydraulic dump cylinder pivoted at a first end portion to said bucket and pivoted at a second end portion to said second side arm member, said first and second dump cylinders being operable together to pivot the bucket in either direction about said second pivot axis; and low pressure relief means for relieving hydraulic fluid pressure above a preselected magnitude at the bucket side of said first and second dump cylinders, said low pressure relief means being operable to permit said second dump cylinder to extend as said tilt cylinder portion extends and to permit said first dump cylinder to extend as said tilt cylinder portion retracts to thereby relieve stresses on the bucket during operation of said tilt cylinder portion.

12. A load handling vehicle according to claim 11 in which the stroke of said tilt cylinder is less than the stroke of said hoist cylinder portion.

13. A load handling vehicle according to claim 11 in which said first hoist cylinder and said hoist cylinder portion are of the same stroke.

14. A load handling vehicle according to claim 11 in which the rod end of each dump cylinder is pivoted to said bucket so that said low pressure relief means relieves pressure above a preselected magnitude at the rod end of such cylinders.

15. In a load handling vehicle having first and second parallel spaced apart hydraulic hoist cylinder means for raising and lowering a bucket supporting frame, the improvement comprising a tilt cylinder means operable along the same line as one of said hoist cylinder means for twisting the frame to tilt the bucket.

16. An apparatus according to claim 15 in which said one of said hoist cylinder means and said tilt cylinder means comprise a tandem cylinder means.

* * * * *